US011220905B2

(12) United States Patent
Hunter et al.

(10) Patent No.: US 11,220,905 B2
(45) Date of Patent: Jan. 11, 2022

(54) METHOD AND APPARATUS FOR CONTROLLING DOWNHOLE WATER PRODUCTION

(71) Applicant: Swellfix UK Limited, Westhill (GB)

(72) Inventors: John Hunter, Westhill (GB); Anthony Wilson, Insch (GB)

(73) Assignee: Swellfix UK Limited, Aberdeenshire (GB)

( * ) Notice: Subject to any disclaimer, the term of this patent is extended or adjusted under 35 U.S.C. 154(b) by 0 days.

(21) Appl. No.: 16/650,621

(22) PCT Filed: Sep. 27, 2018

(86) PCT No.: PCT/GB2018/052760

§ 371 (c)(1),
(2) Date: Mar. 25, 2020

(87) PCT Pub. No.: WO2019/064008

PCT Pub. Date: Apr. 4, 2019

(65) Prior Publication Data

US 2020/0240266 A1 Jul. 30, 2020

(30) Foreign Application Priority Data

Sep. 27, 2017 (GB) ..... 1715649

(51) Int. Cl.
*E21B 49/08* (2006.01)
*E21B 34/06* (2006.01)
(Continued)

(52) U.S. Cl.
CPC ..... *E21B 49/0875* (2020.05); *E21B 34/06* (2013.01); *E21B 47/12* (2013.01); *E21B 43/08* (2013.01)

(58) Field of Classification Search
CPC .... E21B 34/066; E21B 34/08; E21B 49/0875; E21B 34/06; E21B 47/12; E21B 43/08;
(Continued)

(56) References Cited

U.S. PATENT DOCUMENTS 4,393,485 A * 7/1983 Redden ..... G01V 11/002 367/25
2008/0262737 A1* 10/2008 Thigpen ..... E21B 43/14 702/9

(Continued)

FOREIGN PATENT DOCUMENTS

CN 105114061 A 12/2015
EP 2224233 A1 9/2010

(Continued)

OTHER PUBLICATIONS

International Report on Patentability and Written Opinion for PCT/GB2018/052760 dated Mar. 30, 2020.

(Continued)

*Primary Examiner* — Brad Harcourt
(74) *Attorney, Agent, or Firm* — Harness, Dickey & Pierce, P.L.C.

(57) ABSTRACT

An apparatus for controlling water production in a wellbore comprises a body in the form of a base pipe, the base pipe having an axial flow passage in the form of axial through-bore and a lateral flow passage in the form of radial port. A shroud is disposed around the base pipe and forms a housing of the apparatus. In use, the apparatus forms part of a completion string for location in the wellbore, the apparatus configured to direct production fluid into a production conduit for recovery to surface, perform a quantitative measurement of water content within the production fluid, and vary the fluid flow in the fluid flow path based on the quantitative measurement of water content within the pro- (Continued)

duction fluid to maintain water production at or below a predetermined threshold.

21 Claims, 15 Drawing Sheets

(51) Int. Cl.
*E21B 47/12* (2012.01)
*E21B 43/08* (2006.01)

(58) Field of Classification Search
CPC ..... E21B 2200/06; E21B 43/12; E21B 34/14; E21B 43/14; E21B 43/32
See application file for complete search history.

(56) References Cited

U.S. PATENT DOCUMENTS

| | | | | |
|---|---|---|---|---|
| 2009/0101329 | A1 | 4/2009 | Clem et al. | |
| 2015/0218010 | A1* | 8/2015 | Benavides | C02F 1/004 210/741 |
| 2018/0066515 | A1* | 3/2018 | Balan | E21B 34/06 |

FOREIGN PATENT DOCUMENTS

| | | |
|---|---|---|
| EP | 2317073 A1 | 5/2011 |
| EP | 3336303 A2 | 6/2018 |

OTHER PUBLICATIONS

Rashid Shaibu et al: "An Intelligent Well Approach to Controlling Water Coning Problems in Horizontal Production Wells", Jan. 31, 2017 (Jan. 31, 2017), XP055527447, DOI: 10.17577/IJERTV6IS010265 [retrieved on Nov. 27, 2018].
Fahad Ahmed Dilib et al.: "Closed-loop Feedback Control for Production Optimization of Intelligent Wells under Uncertainty", SPE Intelligent Energy International, Jan. 1, 2012 (Jan. 1, 2012), XP055527451, DOI: 10.2118/150096-MS.
Muhammad Arsalan et al: "SPE-177665-MS Challenges of Permanent Downhole Water Cut Measurement in Multilateral Wells", International Petroleum Exhibition and Conference, Jan. 1, 2015 (Jan. 1, 2015), pp. 1-11, XP055334915, Abu Dhabi, UAE, pp. 2-5.
Pei Xiaohan et al.: "An Electromagnetic Wave Based Water Cut Meter and the Influence Factors of Measuring Accuracy", SPE, Jan. 1, 2015 (Jan. 1, 2015), pp. 20-22, XP055527696, DOI: 10.2118/176413-MS, ISBN: 978-1-61399-390-3.
International Search Report and Written Opinion for PCT/GB2018/052660 dated Dec. 12, 2018.

* cited by examiner

METHOD AND APPARATUS FOR CONTROLLING DOWNHOLE WATER PRODUCTION

CROSS-REFERENCE TO RELATED APPLICATIONS

This application is a national phase under 35 U.S.C. § 371 of PCT International Application No. PCT/GB2018/052760 which has an International filing date of Sep. 27, 2018, which claims priority to United Kingdom Application No. 1715649.8, filed Sep. 27, 2017, the entire contents of each of which are hereby incorporated by reference.

FIELD

The present disclosure relates to downhole water production control, for example for use in oil and/or gas wells.

BACKGROUND

In the oil and gas industry, it is common for a hydrocarbon bearing formation to also include a significant volume of water in addition to oil and/or gas. During hydrocarbon production operations, the water in the formation is typically drawn towards and into the well, a process known as water coning. Equipment required to separate the water from the hydrocarbons requires a significant amount of energy and occupies a significant footprint on the rig or platform. Moreover, while in oil production a certain percentage of produced water might be tolerable and in some instances might assist in recovery, gas production wells are extremely sensitive to produced water with even a small percentage of water adversely affecting the ability to recover the gas to surface.

Water production thus needs to be managed in order to maintain efficient hydrocarbon recovery and a number of water management techniques have been developed. In some instances, inflow control equipment is incorporated along a production completion with the aim of balancing draw-down across a reservoir and delaying water on-set or coning into any one region. In some examples, inflow control devices are distributed along the length of the production completion, with each device providing a preset degree of choking to production. Such inflow control systems, while very effective in many circumstances, are better suited for horizontal or deviated wells, and in some cases the preset choking may, over-time, no longer fully match the production conditions. Autonomous inflow control devices are used which will close when exposed to water inflow, thereby closing off any further production from the adjacent reservoir region. Such autonomous inflow control devices react to a change in the hydrodynamic flowing conditions through the inflow control devices caused by the lower viscosity of water relative to oil, closing when exposed to flow having a lower viscosity. While autonomous devices have been used to great effect in many applications, there are limitations in their application. For example, the principle of operation whereby the device closes or chokes in response to lower fluid viscosities means that such devices cannot normally be used for gas production.

SUMMARY

A first aspect of the present disclosure relates to a method for controlling water production in a wellbore, comprising:

directing flow of a production fluid into a production conduit via a fluid flow path;

performing a quantitative measurement of water content within the production fluid; and varying the fluid flow in the fluid flow path based on the quantitative measurement of water content within the production fluid to maintain water production at or below a predetermined threshold.

Beneficially, varying the fluid flow in the fluid flow path based on the quantitative measurement of water content permits greater control over water ingress into the production conduit. This, in turn, results in greater control over produced water from a given formation, permitting water production to be tailored to an optimum level for a given formation. Moreover, the ability to control water production in the downhole environment obviates or at least reduces the requirement for water/hydrocarbon separation facilities at surface, reducing expenditure and/or floor space on the rig or platform.

Directing flow of the production fluid into the production conduit via the fluid flow path may comprise directing the production fluid through a radial port.

Directing flow of the production fluid into the production conduit via the fluid flow path may comprise directing the production fluid through a valve arrangement.

The method may comprise varying the fluid flow in the fluid flow path autonomously.

Beneficially, autonomously varying the fluid flow in the fluid flow path obviates the requirement for control and communication from surface, although in particular embodiments such control and communication equipment may be provided to permit control from surface where desired.

In an oil production well, autonomously varying the fluid flow in the fluid flow path assists in maintaining water ingress at a level which optimises oil recovery. This may be achieved in real time. Moreover, the ability to autonomously control water ingress within a gas production flow provides the operator with additional capability, not otherwise available with conventional equipment and methodologies.

The method may comprise varying the fluid flow in the fluid flow path from surface.

The method may comprise varying the fluid flow in the fluid flow path from surface using a communication arrangement.

As described above, the method comprises varying the flow fluid in the fluid flow path.

Varying the fluid flow in the fluid flow path may comprise reducing the flow in fluid flow path when the quantitative measurement of water content reaches or is above the predetermined threshold.

Varying the fluid flow in the fluid flow path may comprise reducing the size of the fluid flow path.

Varying the fluid flow in the fluid flow path may comprise reducing the size of the fluid flow path using the valve arrangement.

Reducing the size of the fluid flow path may comprise reducing the size of the fluid flow path while maintaining flow in the fluid flow path.

Reducing the fluid flow through the fluid flow path may comprise choking the fluid flow path.

In some examples the predetermined threshold is zero. In such embodiments, the method comprises varying the fluid flow in the fluid flow path to maintain water production at the zero threshold.

In some examples the predetermined threshold may be non-zero, that is the method may maintain some water content within the production fluid.

Reducing the size of the fluid flow path may comprise fully closing the fluid flow path. For example, when it is recognised that the predetermined threshold cannot be dropped below a given value, the method may comprise closing the fluid flow path.

The fluid flow path may be configurable in three configurations. The fluid flow path may be configured in a first, fully open, configuration. The fluid flow path may be configured in a second, full closed, configuration. The fluid flow path may be configured in at least one intermediate configuration. In particular embodiments, the fluid flow path may be configured in a plurality of intermediate configurations.

Beneficially, the apparatus and method of the present disclosure provide the capability to choke flow in the fluid flow path, providing additional capability to manage flow over conventional equipment and methodologies which provide only fully open or fully closed configurations.

The method may comprise varying the fluid flow in the fluid flow path to increase the flow in the fluid flow path.

Varying the fluid flow in the fluid flow path to increase the flow in the fluid flow path may comprise increasing the flow in the fluid flow path when the quantitative measurement of water is below the predetermined threshold.

Varying the fluid flow in the fluid flow path may comprise increasing the size of the fluid flow path.

Varying the fluid flow in the fluid flow path may comprise increasing the size of the fluid flow path using the valve arrangement.

Beneficially, the apparatus and method of the present disclosure provide the capability to increase and/or re-open flow in the fluid flow path, providing additional capability to manage flow over conventional equipment and methodologies which permanently close in response to water production. For example, where a given zone is isolated the water coning effect described above may subside over time, providing an operator with the opportunity to extract additional hydrocarbons.

The method may comprise maintaining the flow path when the quantitative measurement of water content in the production fluid is at or below the predetermined threshold.

Embodiments of the present disclosure thus provide the operator with the capability to control ingress of water into the production conduit by at least one of: decreasing flow through the fluid flow path by choking or closing the fluid flow path using the valve arrangement, when the water content is above the predetermined threshold; maintaining and/or increasing the flow path using the valve arrangement when the quantitative measurement of water content in the production fluid is below the predetermined threshold.

The method may comprise performing the quantitative measurement of water content within the production fluid in the fluid flow path.

The method may comprise performing the quantitative measurement of water content within the production fluid using a sensor arrangement.

The method may comprise detecting the presence of water within the production fluid.

The method may comprise detecting the presence of water using a sensor arrangement.

The method may comprise communicating the quantitative measurement of water content within the production fluid to surface.

The method may comprise communicating the quantitative measurement of water content within the production fluid to surface using a communication arrangement.

The fluid flow path may include a first flow path and the method may comprise permitting flow of a production fluid into the production conduit via a second variable flow path. The second variable flow path may be axially separated along the production conduit from the first variable flow path.

A second aspect of the present disclosure relates to an apparatus for controlling water ingress into a production conduit within a wellbore, comprising:

a body comprising an axial flow passage and a lateral flow passage configured to provide fluid communication with the axial flow passage, the apparatus defining a fluid flow passage for directing flow of a production fluid into the production conduit via a fluid flow path;

a sensor arrangement configured to perform a quantitative measurement of water content within the production fluid; and a valve arrangement configured to vary the fluid flow in the fluid flow path based on the quantitative measurement of water within the production fluid to maintain water production at or below a predetermined threshold.

In use, the apparatus may be configured for location in a borehole, the apparatus operable to vary the fluid flow in the fluid flow path based on the quantitative measurement of water within the production fluid to maintain water production at or below a predetermined threshold.

Beneficially, varying the fluid flow in the fluid flow path based on the quantitative measurement of water content permits greater control over water ingress into the production conduit. This, in turn, results in greater control over produced water from a given formation, permitting water production to be tailored to an optimum level for a given formation. Moreover, the ability to control water production in the downhole environment obviates or reduces the requirement for surface water/hydrocarbon separation facilities at surface, reducing expenditure and/or floor space at surface.

The apparatus may be configured to vary the fluid flow in fluid flow path autonomously.

Beneficially, autonomously varying the fluid flow in the fluid flow path obviates the requirement for control and communication equipment from surface, although in particular embodiments such control and communication equipment may be provided to permit control from surface where desired.

In an oil production well, autonomously varying the fluid flow in the fluid flow path assists in maintaining water ingress at a level which optimises oil recovery. This may be achieved in real time.

Moreover, the ability to autonomously control water ingress within a gas production flow provides the operator with additional capability, not otherwise available with conventional equipment and methodologies.

As described above, the apparatus comprises a valve arrangement configured to vary the fluid flow in the fluid flow path based on the quantitative measurement of water within the production fluid to maintain water production below a predetermined threshold.

In particular embodiments, the valve arrangement may comprise a choke valve.

The valve arrangement may comprise an actuator.

The actuator may comprise a linear actuator.

The actuator may comprise a magnetic actuator.

The actuator may comprise a linear reluctance motor.

The actuator may comprise an electric actuator.

The actuator may comprise a hydraulic actuator.

The actuator may comprise an electro active polymer actuator.

The valve actuator may comprise an electric linear actuator.

The valve actuator may be interposed between the body and the housing of the apparatus.

The valve arrangement may comprise a valve member.

The valve arrangement may be configured to occlude the radial flow passage using the valve member.

The valve member may comprise a port, such as a small weep port.

The actuator may comprise a sensor configured to determine the position of the valve member.

The actuator may be configured to communicate the position of the valve member. For example, the sensor configured to determine the position of the valve member may output a signal indicating the position of the valve member.

As described above, the apparatus comprises a sensor arrangement

The sensor arrangement may comprise a sensor configured to detect one or more property of the production fluid indicative of the presence of water and/or the water content within the production fluid.

The sensor arrangement may comprise a sensor configured to detect the presence of water.

The sensor arrangement may be configured to provide an output signal indicative of the water content in the production fluid. As hydrocarbons have a significantly lower conductivity than water, no signal (or a low signal) is generated by the hydrocarbon content of the production fluid in the fluid flow path. When water is present in the production fluid, the flow rate of the production fluid is proportional to sensor output, giving an output signal indicative of the water content.

The sensor configured to detect the presence of water may, for example, comprise an electrical conductivity (EC) sensor.

The sensor arrangement may comprise a sensor configured to determine the water content in the production fluid, that is the percentage water content.

The sensor configured to determine the water content in the production fluid may provide an output indicative of the water content in the production fluid.

The sensor arrangement may also comprise a light emitting and receiving system. In use, the sensor arrangement may be configured to detect at least one of the presence and/or content of water due to the variation in the received light.

The sensor arrangement, in particular but not exclusively the sensor configured to detect the water content, may be configured to detect flow rate of the production fluid.

The sensor configured to detect the flow rate of the production fluid may comprise a flow meter.

At least one sensor of the sensor arrangement may comprise an electromagnetic (EM) sensor.

In particular embodiments, the sensor arrangement may comprise both an EC sensor and an EM sensor.

The EM sensor may be disposed downstream of the EC sensor.

At least sensor of the sensor arrangement may be passive.

At least one sensor of the sensor arrangement may be reconfigurable from a passive state to an active or "awake" state.

Beneficially, the sensor arrangement may be reconfigurable from a passive state, operating with low power consumption, to an active state when water is detected.

As described above, the apparatus comprises a body comprising an axial flow passage and a lateral flow passage configured to provide fluid communication with the axial flow passage, the apparatus defining a fluid flow passage for directing flow of a production fluid into the production conduit via the fluid flow path.

The body may comprise a base pipe.

The axial flow passage may take the form of an axial throughbore.

The axial throughbore may be formed in the base pipe.

The axial flow passage of the apparatus may be configured to form part of a production conduit for directing the production fluid to surface.

The body may form part of a tubular string, such as a completion string.

The apparatus may comprise a housing.

The housing may be disposed around at least part of the body.

The housing may take the form of a shroud.

The apparatus may comprise a screen.

The screen may comprise a sand screen.

The screen may be coupled to, or form part of, the housing.

The apparatus may comprise a coupling arrangement.

In particular embodiments, the coupling arrangement may comprise a thread connector.

The apparatus may comprise a communication arrangement.

The communication arrangement may comprise a wired communication arrangement.

The communication arrangement may comprise a wireless communication arrangement.

In particular embodiments, the communication arrangement may comprise a static pressure communication arrangement.

The communication arrangement may comprise a pressure pulse telemetry system.

The communication arrangement may comprise a radio frequency (RF) signal system.

The communication arrangement may comprise an electromagnetic (EM) signal system.

The valve arrangement, e.g. the choke valve, may form part of the communication arrangement.

The apparatus may comprise a controller.

The controller may comprise a CPU.

The controller may be configured to monitor the output from the sensor arrangement.

The controller may be configured to determine, from the output from the sensor arrangement, the water content of the production fluid.

The controller may be configured to actuate the valve arrangement in response to the output.

The sample rate of the system may vary, e.g. it may be infrequent in normal operation, but as water is detected, the frequency increase to capture this and then the sample rate reduce as a steady state is observed.

The system may also log production of water over time and make decisions based on cumulative values rather than instantaneous flow.

The apparatus may comprise a power supply.

The power supply may comprise a downhole power supply.

The power supply may comprise an onboard power supply.

The power supply may comprise a downhole power generator.

The power supply may comprise a battery.

The battery may comprise a lithium ion battery.

The power supply may comprise a cabled connection to surface.

The production fluid may comprise a hydrocarbon.

The production fluid may comprise oil.

The production fluid may comprise gas.

Beneficially, the ability to control water ingress within a gas production flow provides additional capability to the operator, not otherwise available with conventional equipment and methodologies.

A third aspect relates to a system for downhole water ingress control, comprising the apparatus according to the second aspect.

The system may comprise a completion string.

The apparatus may be configured for coupling to, or may be integrally formed with, the completion string.

The system may be configured to provide independent control between first and second fluid flow paths. Alternatively, control between the first and second flow paths may be integrated. For example, in a vertical well one apparatus may be provided above another, the upper apparatus remaining dormant until the lower apparatus has performed an action.

A fourth aspect relates to a processing system configured to implement one or more of the previous aspects.

The processing system may comprise at least one processor. The processing system may comprise and/or be configured to access at least one data store or memory.

The data store or memory may comprise or be configured to receive operating instructions or a program specifying operations of the at least one processor.

The at least one processor may be configured to process and implement the operating instructions or program.

The at least one data store may comprise one or more of a flash drive, eePROM, or other suitable data store.

The processing system may comprise a network or interface module. The network or interface module may be connected or connectable to a network connection or data carrier, which may comprise a wired or wireless network connection or data carrier, such as a data cable, radio frequency signal, electromagnetic signal, or other suitable data carrier.

The processing system may comprise a processing apparatus or a plurality of processing apparatus. Each processing apparatus may comprise at least a processor and optionally a memory or data store and/or a network or interface module. The plurality of processing apparatus may communicate via respective network or interface modules. The plurality of processing apparatus may form, comprise or be comprised in a distributed or server/client based processing system.

A fifth aspect relates to a computer program product configured such that when processed by a suitable processing system configures the processing system to implement one or more of the previous aspects.

The computer program product may be provided on or comprised in a carrier medium. The carrier medium may be transient or non-transient. The carrier medium may be tangible or non-tangible. The carrier medium may comprise a signal such as an electromagnetic or electronic signal. The carrier medium may comprise a physical medium, such as a disk, a memory card, a memory, and/or the like.

According to another aspect, there is provided a carrier medium, the carrier medium comprising a signal, the signal when processed by a suitable processing system causes the processing system to implement one or more of the previous aspects.

It will be well understood by persons of ordinary skill in the art that whilst some embodiments may implement certain functionality by means of a computer program having computer-readable instructions that are executable to perform the method of the embodiments. The computer program functionality could be implemented in hardware (for example by means of a CPU or by one or more ASICs (application specific integrated circuits)) or by a mix of hardware and software.

Whilst particular pieces of apparatus have been described herein, in alternative embodiments, functionality of one or more of those pieces of apparatus can be provided by a single unit, processing resource or other component, or functionality provided by a single unit can be provided by two or more units or other components in combination. For example, one or more functions of the processing system may be performed by a single processing device, such as a personal computer or the like, or one or more or each function may be performed in a distributed manner by a plurality of processing devices, which may be locally connected or remotely distributed.

It will be understood that the features defined above in relation to an aspect or described below may be utilised in isolation or in combination.

BRIEF DESCRIPTION OF THE DRAWINGS

These and other aspects will now be described, by way of example only, with reference to the accompanying drawings, in which.

DETAILED DESCRIPTION OF THE DRAWINGS

Figure 1:
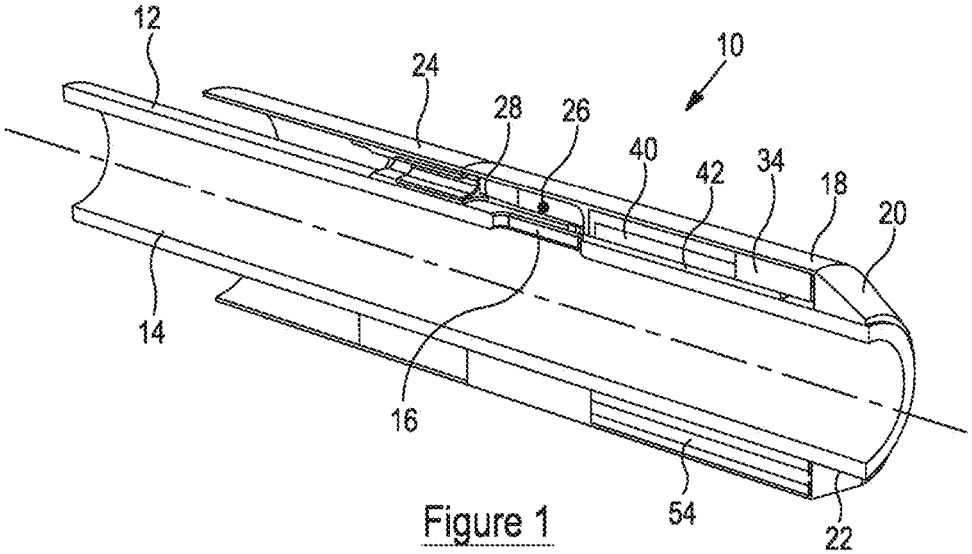
FIG. 1 is a perspective cut away view of an apparatus according to an embodiment of the present disclosure.

FIG. 1 of the accompanying drawings shows an apparatus 10 for controlling water production in a wellbore B (shown in FIGS. 7 to 13A), according to an embodiment of the present disclosure.

Figure 14:
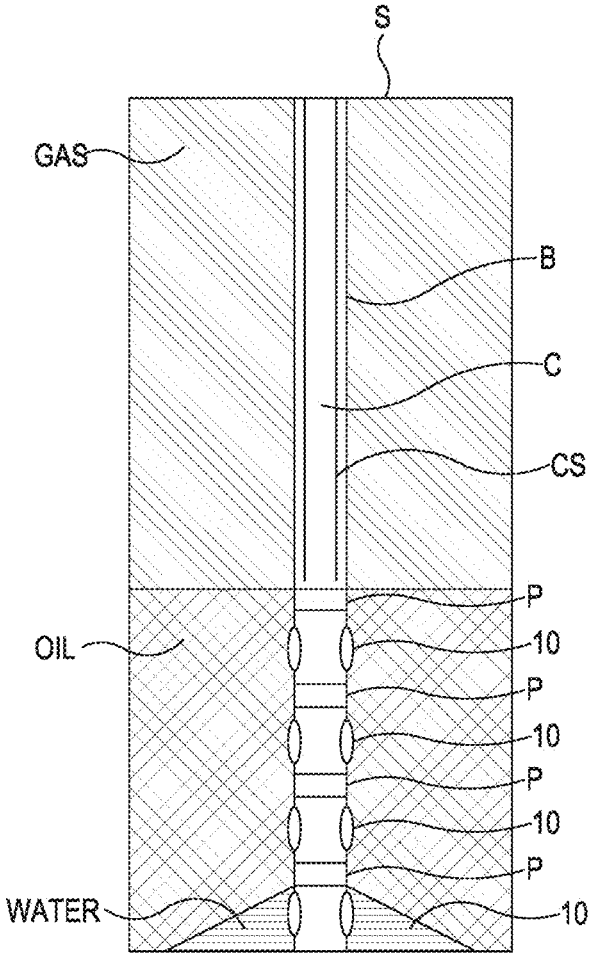
FIG. 14 shows a completion system according to an embodiment of the present disclosure.

In use, and as will be described further below with reference to FIGS. 14 to 15H, the apparatus 10 forms part of a completion string CS for location in the wellbore B, the apparatus 10 configured to direct production fluid into a production conduit P for recovery to surface S, perform a quantitative measurement of water content within the production fluid, and vary the fluid flow in the fluid flow path based on the quantitative measurement of water content within the production fluid to maintain water production below a predetermined threshold.

As shown in FIG. 1, the apparatus 10 comprises a body in the form of a base pipe 12, the base pipe 12 having an axial flow passage in the form of axial throughbore 14 and a lateral flow passage in the form of radial port 16. In use, the axial throughbore 14 forms a conduit for receiving production fluid in the wellbore B and forms part of the production conduit C for directing the production fluid to surface. The radial port 16 is formed through the wall of the base pipe 12 and, in use, communicates the production fluid into the throughbore 14.

A shroud 18 is disposed around the base pipe 12 and forms a housing of the apparatus 10. In the illustrated embodiment, the shroud 18 comprises a separate component to the base pipe 12 and is coupled to the base pipe 12 at end ring portion 20 via a threaded connection 22. It will be recognised, however, that the shroud 18 and base pipe 12 may be secured together by any suitable coupling arrangement, such as a welded connection, adhesive bond, quick connect, interference fit or the like, or may be integrally formed.

In the illustrated embodiment, a screen in the form of sand screen 24 is disposed around the base pipe 12. Beneficially, the sand screen 24 prevents entrained sand or other particulate matter from being produced to surface S. Other embodiments of the apparatus 10 may, however, operate without a screen.

As shown in FIG. 1, an annulus 26 is defined between the base pipe 12 and the shroud 18, the annulus 26 forming a fluid flow path for directing the production fluid to the radial port 16. A flow guide 28 is disposed within, or formed in, the shroud 18, the flow guide 28 operable to assist in directing the axially directed production fluid flow radially through the radial port 16.

Figure 2:
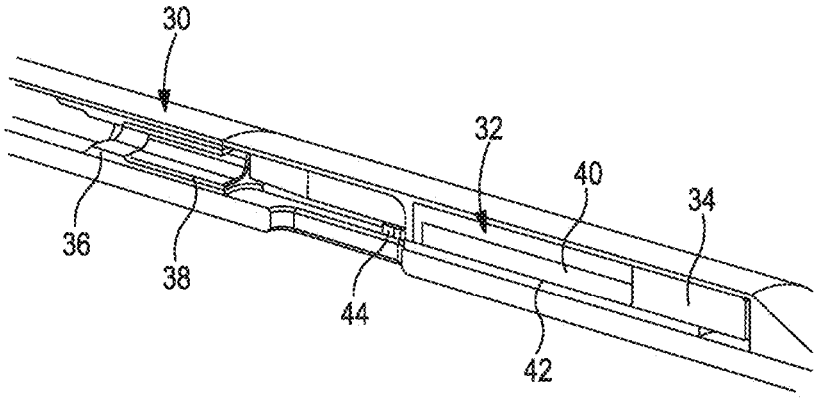
FIG. 2 shows an enlarged view of part of the apparatus shown in FIG. 1.

Referring now also to FIG. 2 of the accompanying drawings, an enlarged view of a part of the apparatus 10, it can be seen that the apparatus 10 further comprises a sensor arrangement 30, a valve arrangement 32 and a controller 34.

The sensor arrangement 30 is disposed in the annulus 26 of the apparatus 10 and is configured to perform a quantitative measurement of water content within the production fluid.

In the illustrated embodiment, the sensor arrangement 30 comprises a first sensor in the form of electrical conductivity (EC) sensor 36 and a second sensor in the form of an electromagnetic (EM) flow meter 38. The electrical conductivity sensor 36 is configured to provide an output signal indicating the presence of water in the production fluid passing through the annulus 26 while the electromagnetic (EM) flow meter 38 is configured to provide an output signal indicative of the quantity of water (that is percentage water content) within the production fluid.

While the sensor arrangement 30 in the apparatus 10 comprises two sensors 36,38 in some embodiments the valve arrangement 32 may actuate directly in response to the output signal from the electrical conductivity (EC) sensor 36, or may comprise additional sensors such as a sensor configured to indicate the condition of the valve arrangement 32.

The valve arrangement 32 is operatively associated with the radial port 16 and is configured to vary the fluid flow through the radial port 16 based on the quantitative measurement of water within the production fluid observed by the sensor arrangement 30. In the illustrated embodiment, the valve arrangement 32 takes the form of a choke valve comprising a valve actuator in the form of linear actuator 40 and a valve member in the form of choke trim 42. In the illustrated embodiment, the linear actuator 40 comprises an electromagnetic linear actuator. Beneficially, and as described further below, the linear actuator 40 is configured to permit the choke trim 42 to be moved in increments; permitting a high degree of control over the degree to which fluid flow through the radial port 16 is occluded. In the illustrated embodiment, the choke trim 42 is provided with a weep port 44 (shown in FIG. 2).

Figure 3:
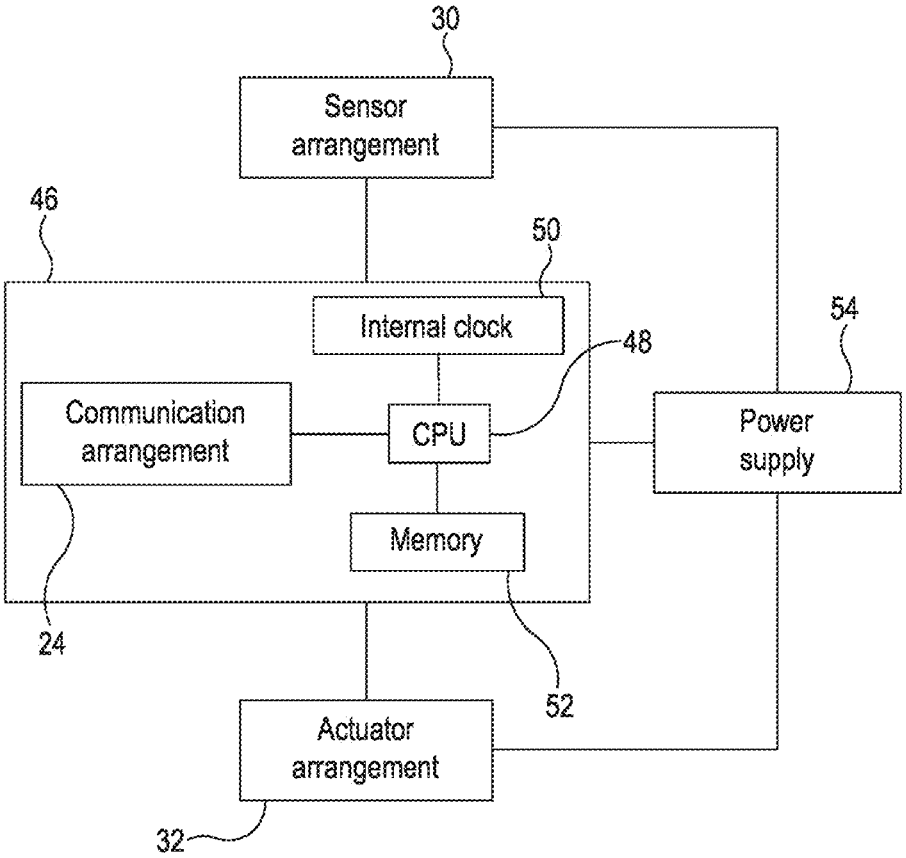
FIG. 3 shows a diagrammatic view of a control system of the apparatus shown in FIG. 1.

Referring now also to FIG. 3 of the accompanying drawings, in the illustrated embodiment the controller 34 comprises a programmable logic controller (PLC) 46. The PLC 46 is operatively associated with the sensor arrangement 30 and the valve arrangement 32, the PLC 46 configured to operate the choke trim 42 of the valve arrangement 32 in response to the output signal(s) received from the sensor arrangement 30.

As shown in FIG. 3, the PLC 46 comprises amongst other things a CPU 48, and an internal clock 50. The PLC 46 may also comprise memory 52 for logging the quantitative measurement of water content within the production fluid over time. Beneficially, the apparatus 10 is thus capable of controlling water ingress, and thereby controlling water production, based on cumulative water content values rather than in response to instantaneous flow conditions.

The apparatus 10 further comprises a power supply for supplying power to at least one of the sensor arrangement 30, valve arrangement 32 and PLC 46. In the illustrated embodiment, the power supply takes the form of a Lithium ion battery 54 housed within the shroud 18. In other embodiments, power to the apparatus 10 may be supplied via a wired connection to surface, or from a downhole power generator.

Figure 4:
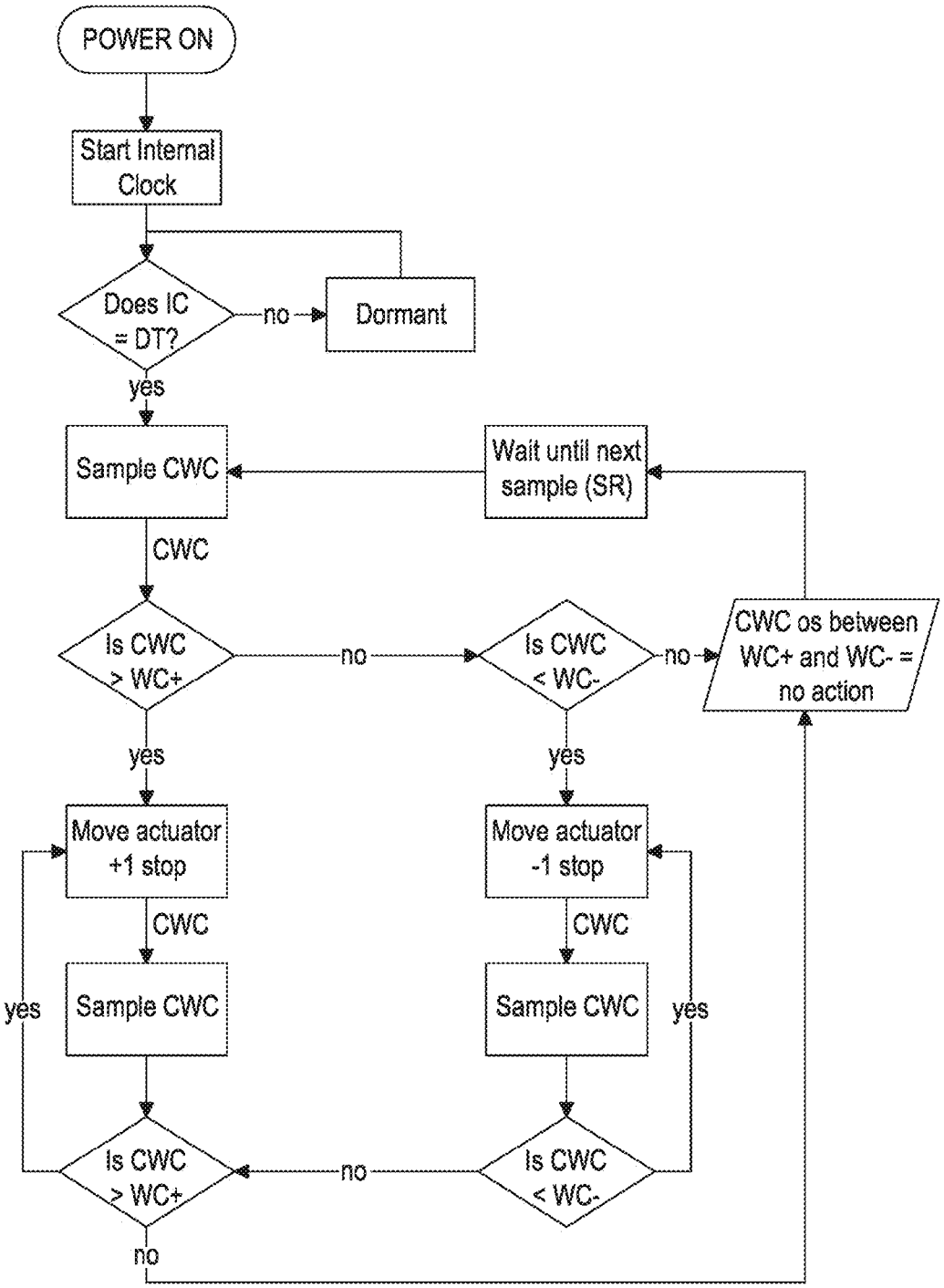
FIGS. 4, 5 and 6 show control system diagrams of the apparatus shown in FIG. 1.
Figure 5:
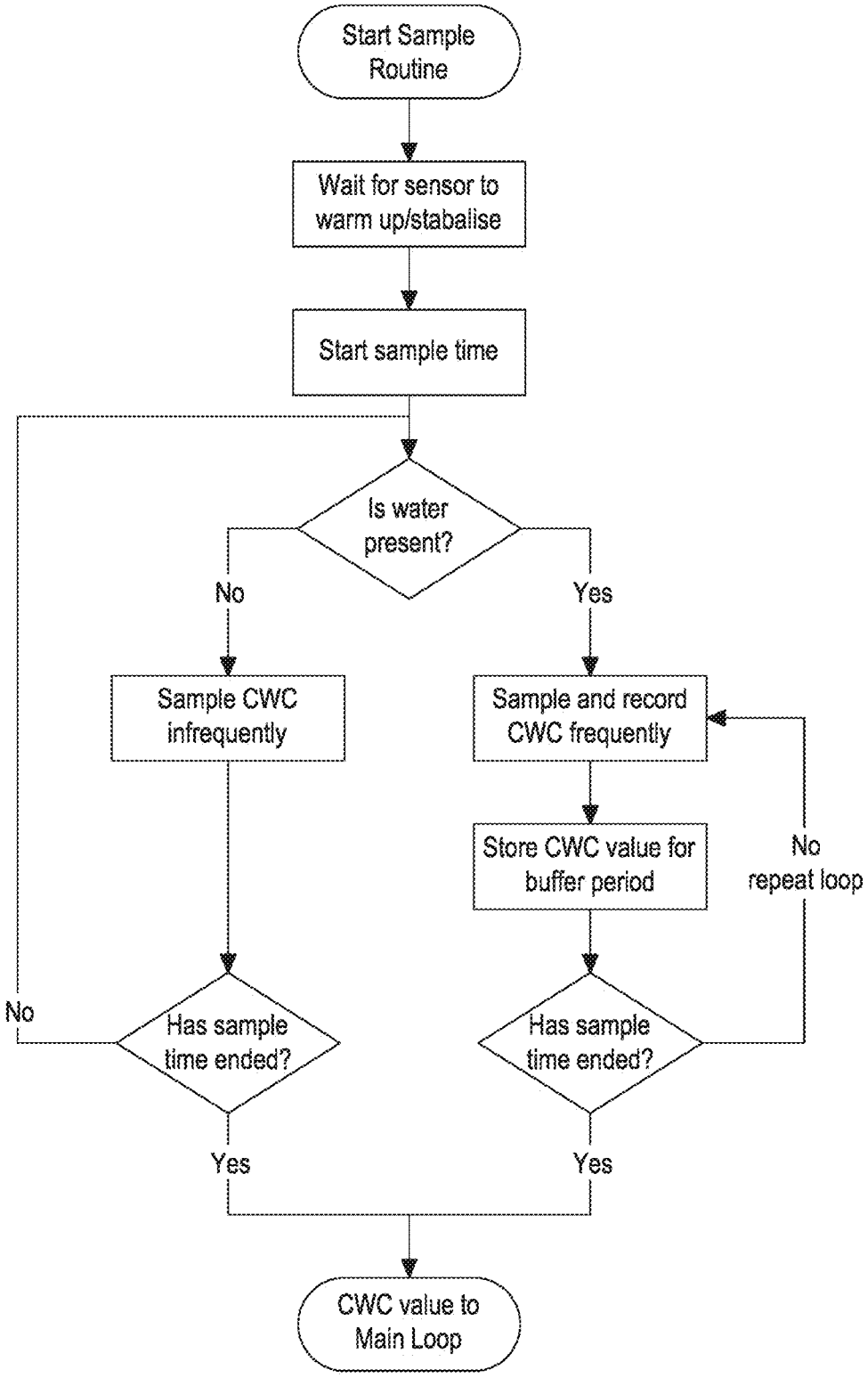
Figure 6:
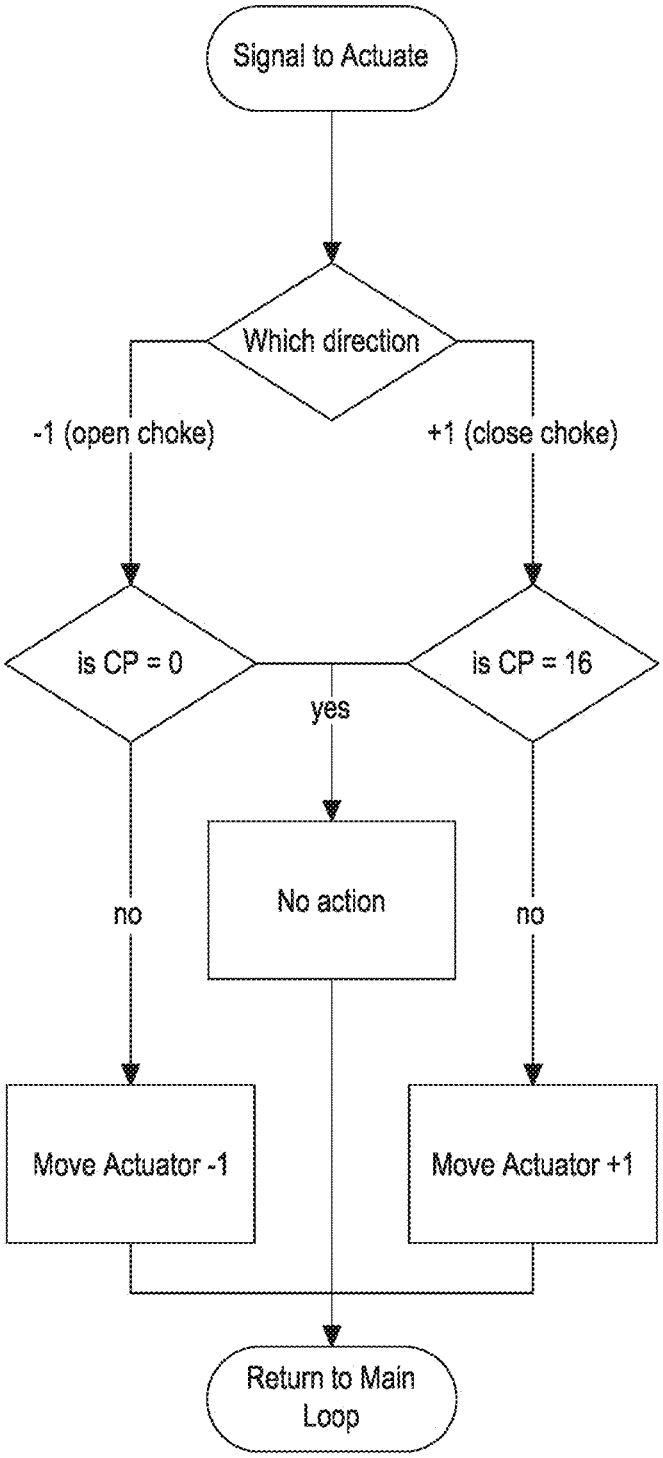

Operation of the apparatus 10 will now be described with reference to FIGS. 1 to 3 and also FIGS. 4 to 13 of the accompanying drawings, of which FIGS. 4, 5 and 6 illustrate control system diagrams for the apparatus 10, and FIGS. 7 to 13A show the apparatus 10 in different configurations.

Figure 7:
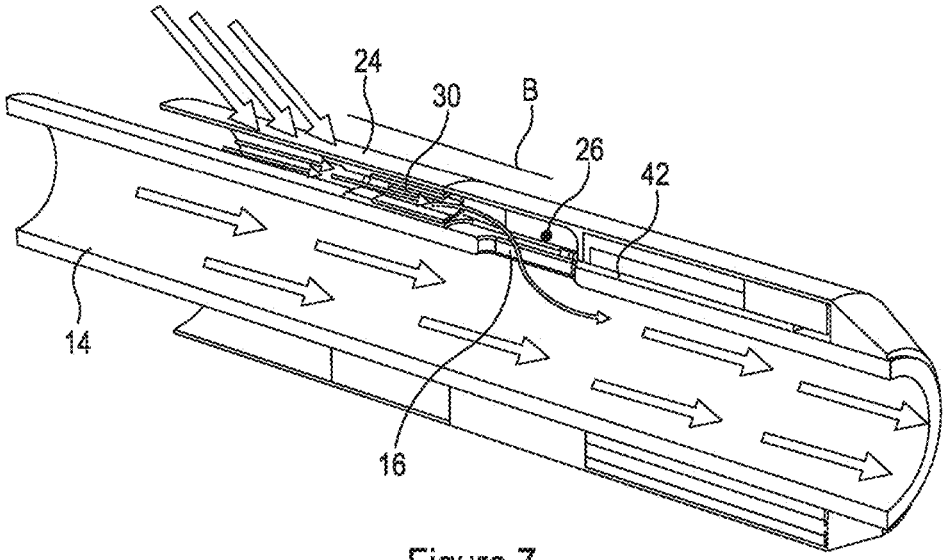
FIG. 7 shows the apparatus shown in FIG. 1 in a first, fully open, configuration.
Figure 7A:
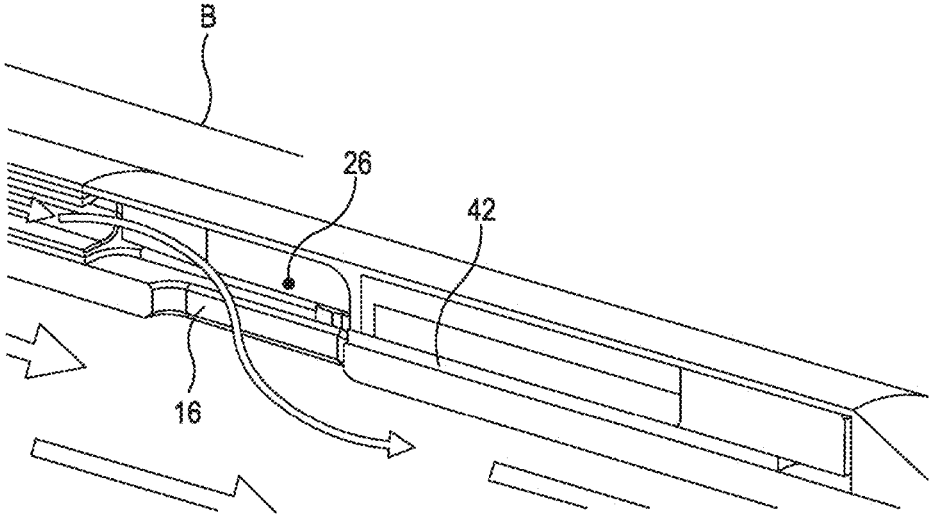
FIG. 7A shows an enlarged view of part of the apparatus shown in FIG. 7.

The apparatus 10 is initially configured as shown in FIGS. 7 and 7A, with the choke trim 42 in a retracted configuration relative to the shroud 18, such that the radial port 16 is fully open. In use, production fluid entering through the sand screen 24 is directed into and along the annulus 26 of the apparatus 10, through the sensor arrangement 30 and into the throughbore 14 via radial port 16.

As shown in FIG. 4, the sensor arrangement 30 is maintained in a dormant condition until the internal clock 50 within the PLC 46 reaches a predetermined time DT, at which predetermined time DT the sensor arrangement 30 is operated to sample and provide an output signal CWC indicating the water content in the production fluid flow through the apparatus 10.

Figure 8:
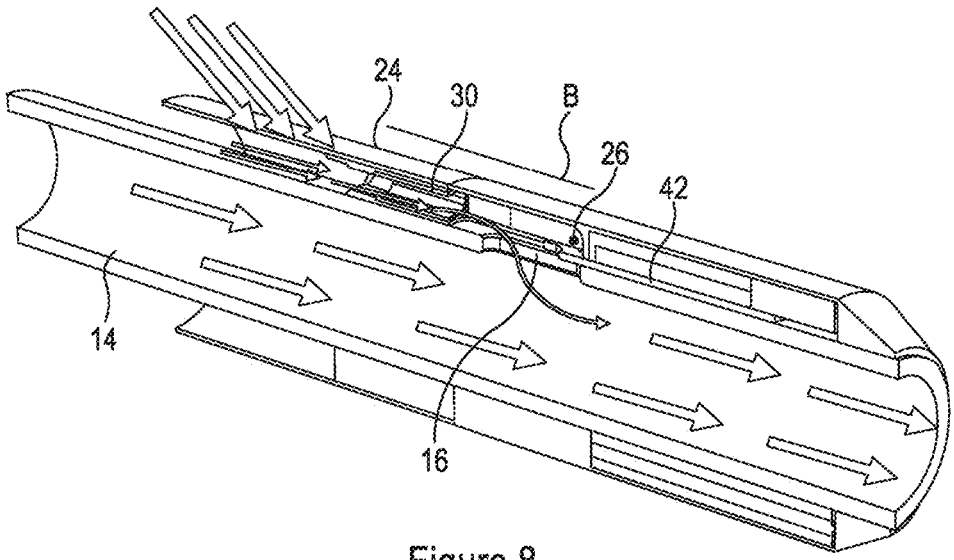
FIG. 8 shows the apparatus in a second, intermediate, configuration.
Figure 8A:
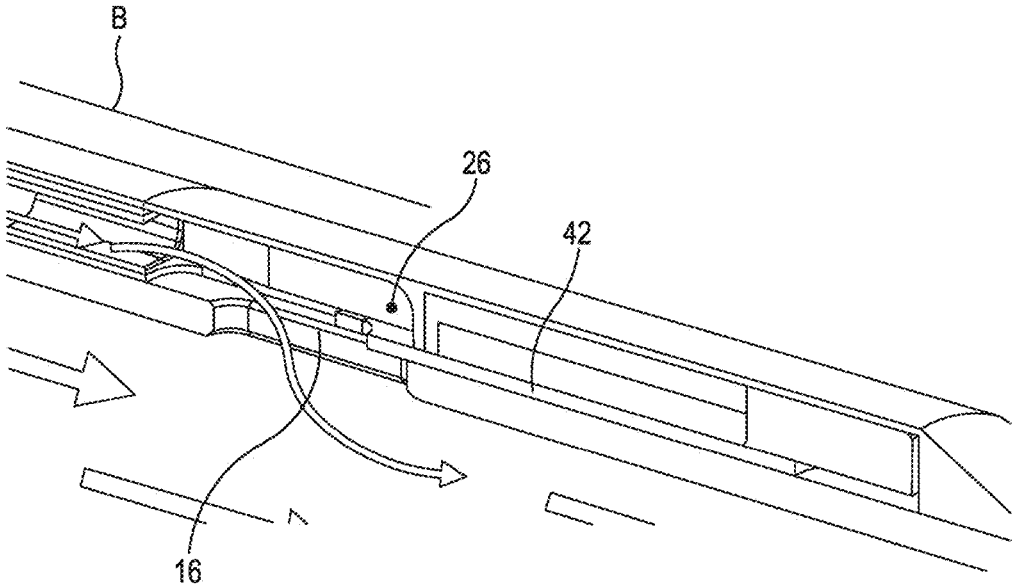
FIG. 8A shows an enlarged view of part of the apparatus shown in FIG. 8.

If the sampled water content is greater than a predetermined threshold value WC+, the PLC 46 signals the valve actuator 40 to extend the choke trim 42 one step, thereby moving the apparatus 10 from the first, fully open, configuration shown in FIGS. 7 and 7A to the second, partially closed, configuration shown in FIGS. 8 and 8A. The sensor arrangement 30 is then again operated to sample and provide an output signal indicating the water content in the production fluid flow through the apparatus 10.

Figure 9:
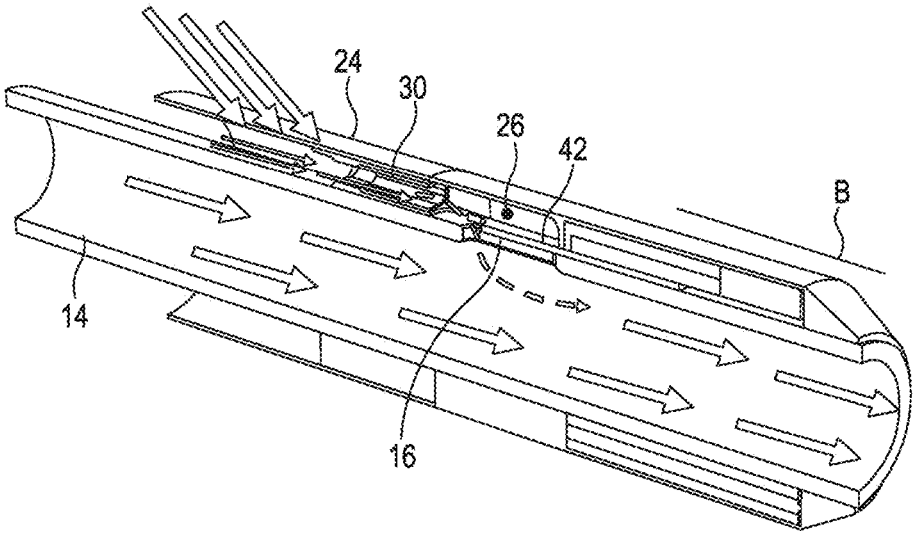
FIG. 9 shows the apparatus in a third, partially closed, configuration.
Figure 9A:
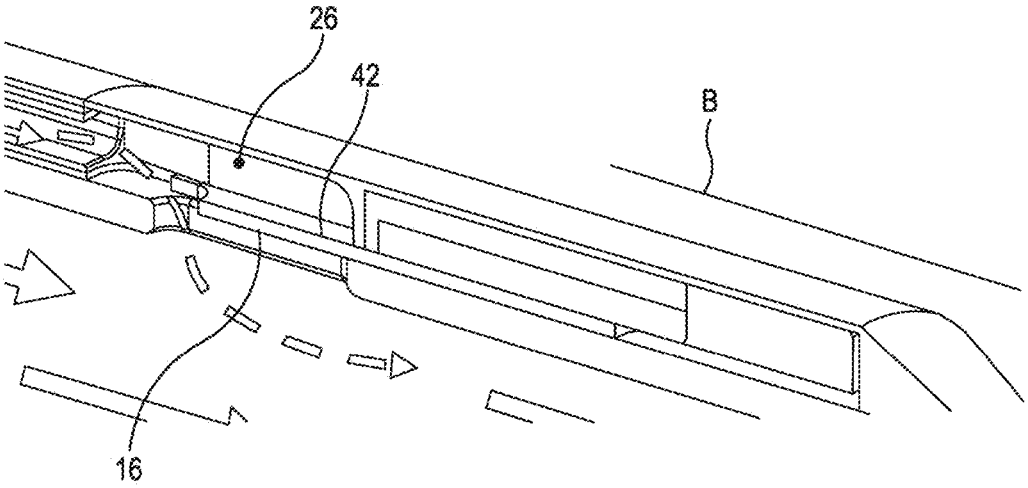
FIG. 9A shows an enlarged view of part of the apparatus shown in FIG. 9.

If the sampled water content CWC remains above the predetermined threshold value CW+, the PLC 46 signals the valve actuator 40 to extend the choke trim 42 another step, thereby moving the apparatus 10 from the configuration shown in FIGS. 8 and 8A to the configuration shown in FIGS. 9 and 9A.

Figure 10:
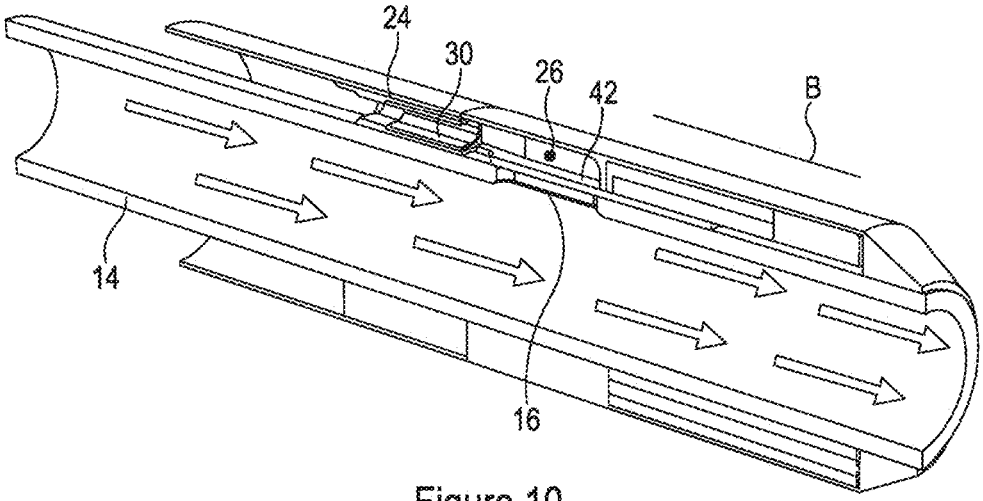
FIG. 10 shows the apparatus in a fourth, fully closed, configuration.
Figure 10A:
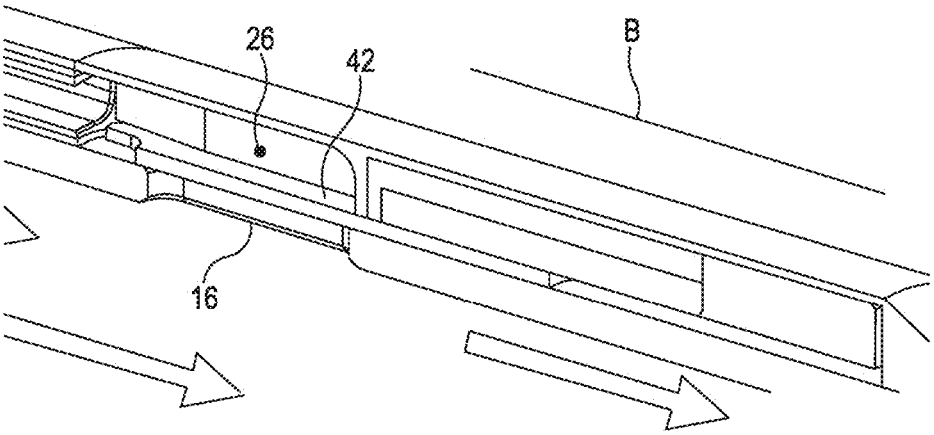
FIG. 10A shows an enlarged view of part of the apparatus shown in FIG. 10.
Figure 11:
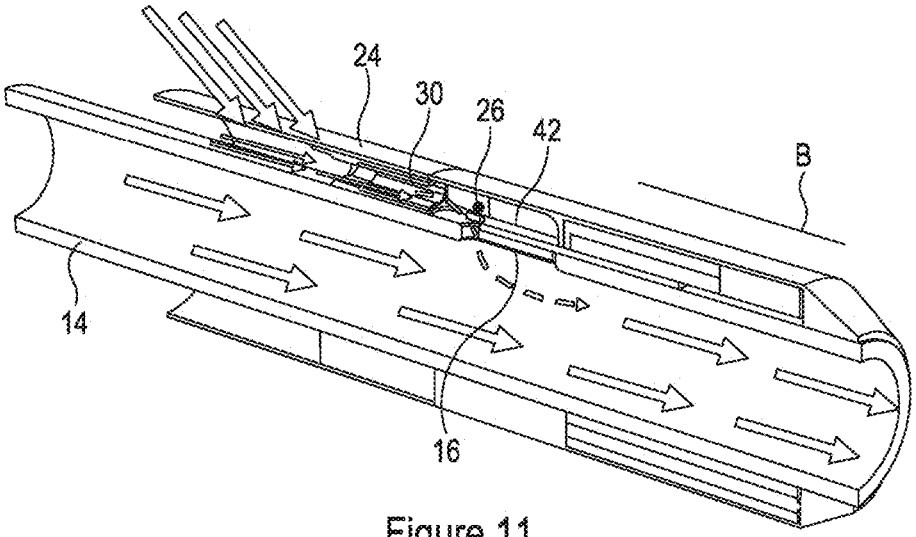
FIG. 11 shows the apparatus in a fifth, partially open, configuration.
Figure 11A:
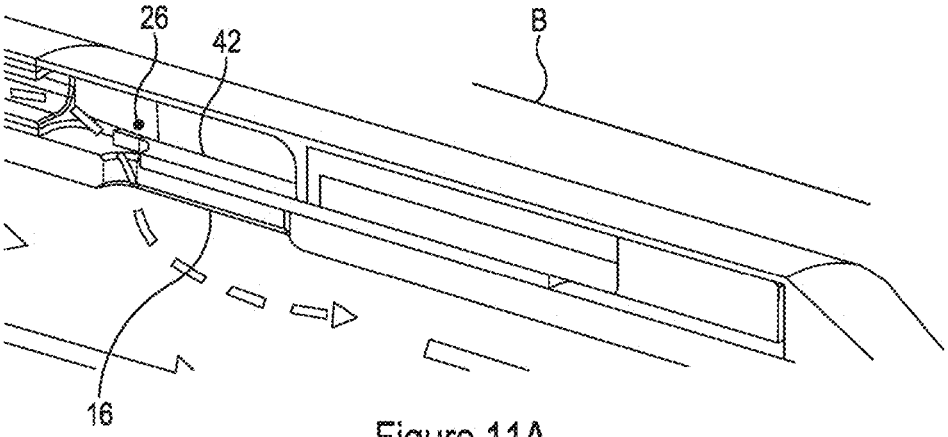
FIG. 11A shows an enlarged view of part of the apparatus shown in FIG. 11.
Figure 12:
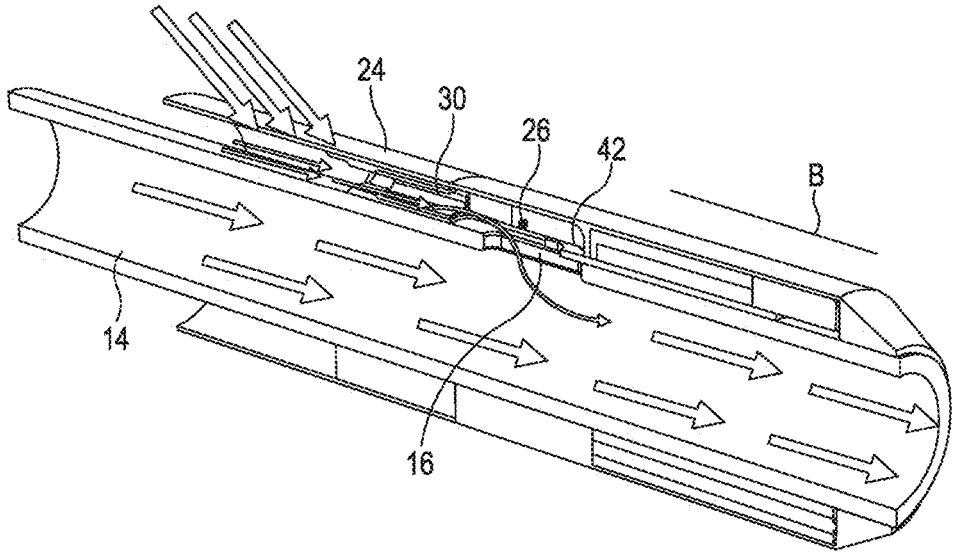
FIG. 12 shows the apparatus in a sixth, partially open, configuration.
Figure 12A:
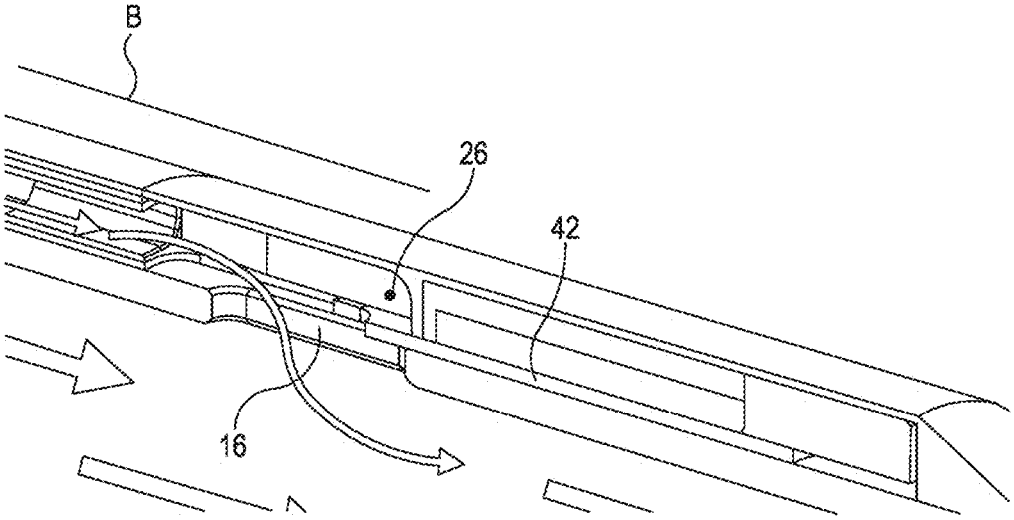
FIG. 12A shows an enlarged view of part of the apparatus shown in FIG. 12.
Figure 13:
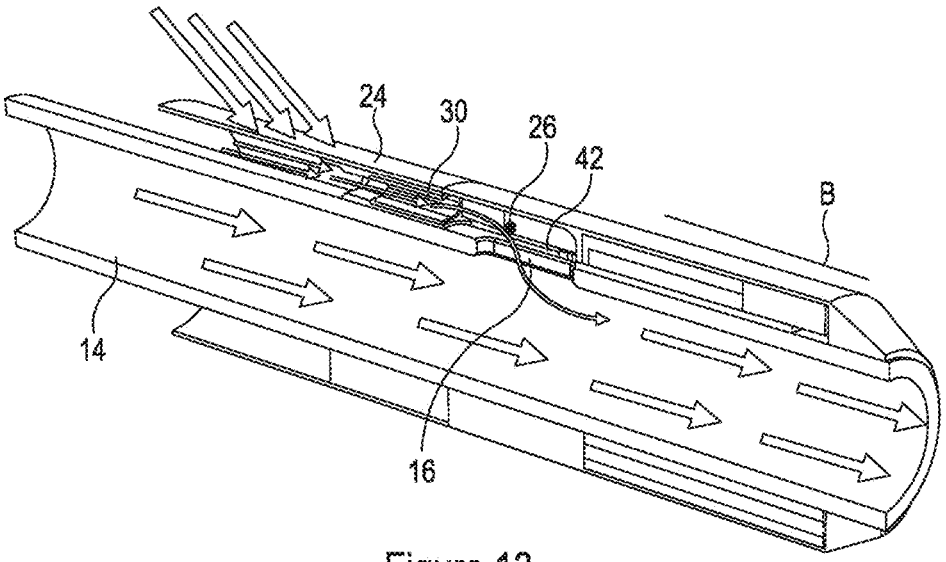
FIG. 13 shows the apparatus in a seventh, fully open, configuration.
Figure 13A:
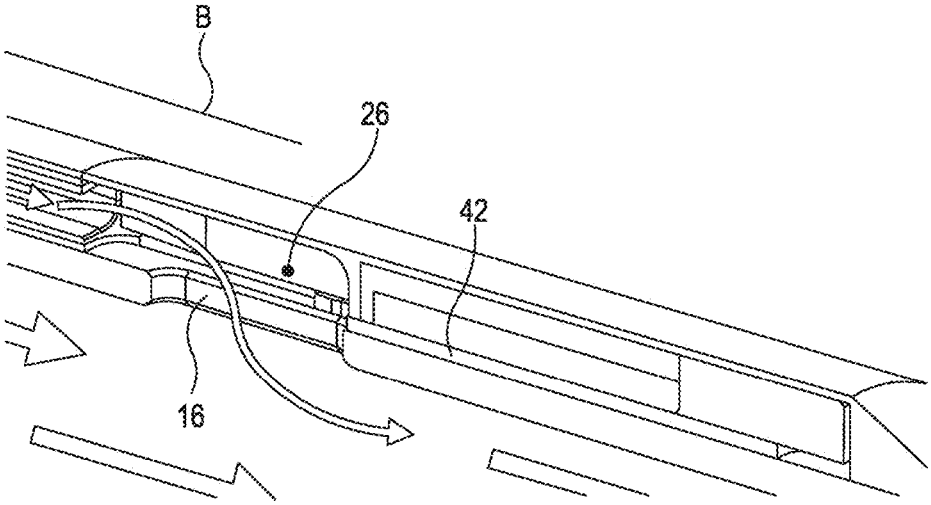
FIG. 13A shows an enlarged view of part of the apparatus shown in FIG. 13.

This process is repeated until the predetermined threshold value CW+is reached or the valve arrangement 32 is fully closed and the apparatus 10 defines the configuration shown in FIGS. 10 and 10A.

In this way, fluid flow through the radial port 16 is variably choked, permitting a greater degree of control over water ingress into the throughbore 14, and water production to surface S; this being achieved autonomously and mitigating the demands on surface separation equipment.

As described above, an apparatus 10 according to embodiments of the present disclosure also provides the ability to increase fluid flow where the sampled water content CWC is below the predetermined threshold.

As shown in FIG. 4, if the sampled water content CWC is not above, or is no longer above, the predetermined threshold value WC+, the controller 34 determines whether the sampled water content CWC is below a lower threshold valve WC-.

If the sampled water content CWC is below the threshold valve WC+but above the lower threshold valve WC-, the controller 34 maintains the position of the valve arrangement 32.

If, however, the sampled water content CWC is below the threshold valve WC+and below the lower threshold valve WC-, the controller 34 signals the valve actuator 40 to retract the choke trim 42 one step, moving the apparatus 10 from the configuration shown in FIGS. 10 and 10A to the configuration shown in FIGS. 11 and 11A or FIGS. 12 and 12A. This process is repeated until the predetermined threshold value is reached or the valve arrangement 32 is fully opened and the apparatus 10 defines the configuration shown in FIGS. 13 and 13A.

As shown in FIG. 5, which illustrates in more detail the control system diagram for the step of sampling the water content shown in FIG. 4, the apparatus 10 is capable—using the sensor 36—of determining and outputting a signal indicative of the presence of water in the production fluid and using the sensor 38 determining and outputting a signal indicative of the percentage of water in the production fluid. As shown in FIG. 5, where the sensor 36 initially detects the presence of water, the sampling rate at which the percentage of water in the production fluid is increased; extending battery life.

FIG. 6 shows a control system diagram for the valve arrangement. In the illustrated embodiment, it can be seen that the valve actuator 40 is capable to 16 increments between fully open and fully closed configurations. However, it will be recognised that the valve actuator 40 may comprise more or less increments as required and in some embodiments may be configured to move directly between open and closed configurations.

It will be recognised that the apparatus 10 provides the ability to control water production in the wellbore B. This can be achieved autonomously. Moreover, the apparatus 10 provides the ability not only to close and/or choke fluid flow through the radial port 16 but also to open or re-open the radial port 16 and thereby increase fluid flow through the radial port 16.

As described above, and referring now also to FIGS. 14 to 15H of the accompanying drawings, the apparatus 10 forms part of a completion system S. In the illustrated embodiment shown in FIG. 14, the completion system S comprises a plurality of the apparatus 10 (four apparatus 10 are shown), each apparatus 10 operatively associated with a given formation zone and isolated by packers P.

Figure 15A:
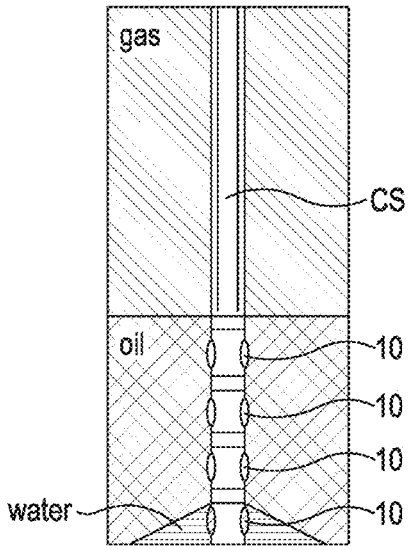
FIGS. 15A to 15H show a method of operation of the completion system shown in FIG. 14.
Figure 15B:
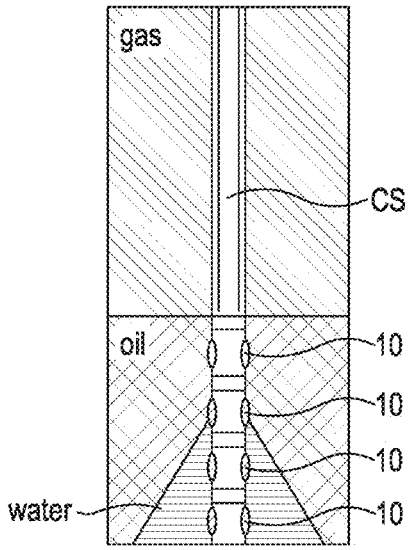
Figure 15C:
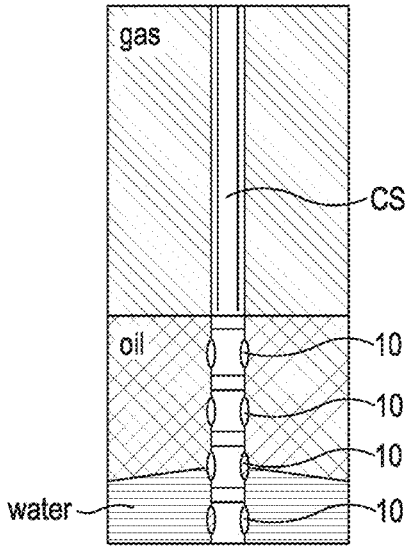
Figure 15D:
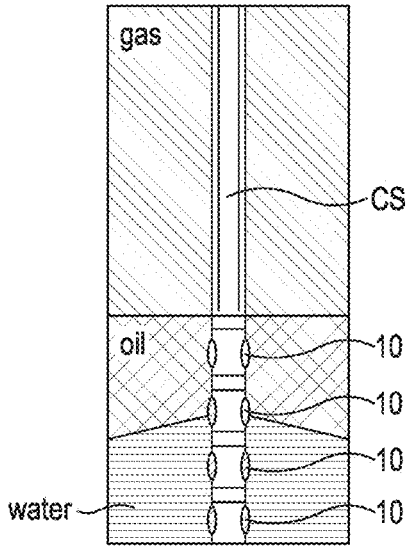
Figure 15E:
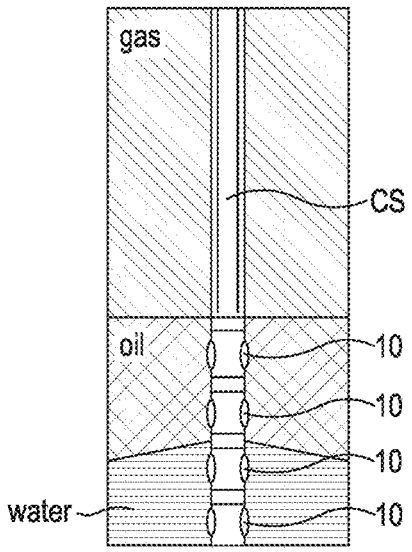
Figure 15F:
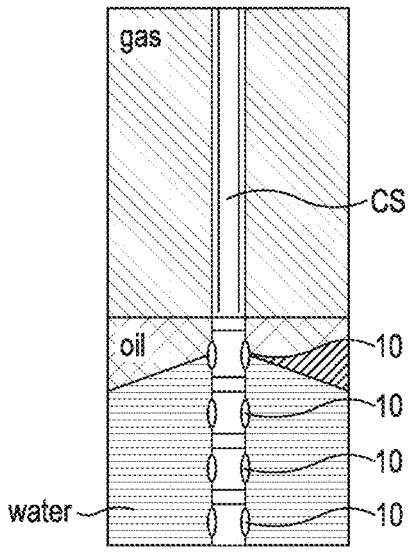
Figure 15G:
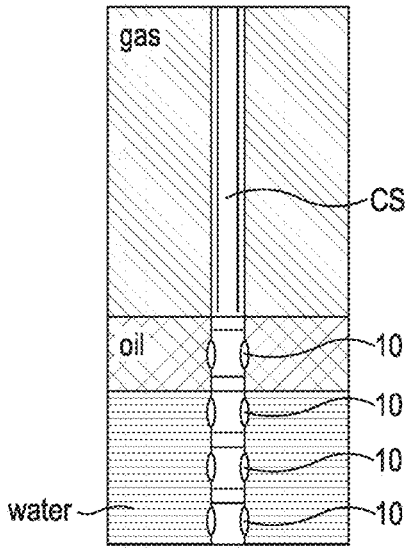
Figure 15H:
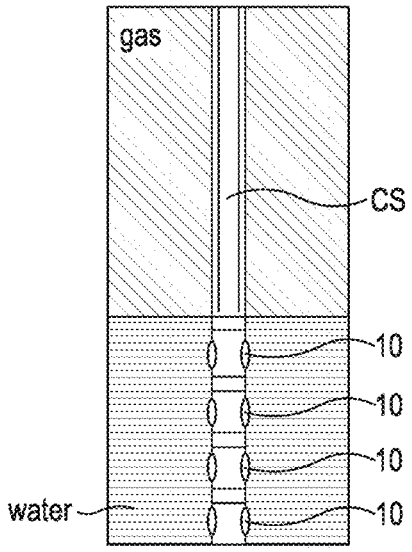

As shown in FIGS. 15A and 15B, where water coning occurs the apparatus 10 of the completion string S are capable of choking and then closing off fluid flow into the production conduit C, in order to limit the amount of water produced to surface. Where the water level subsides, for example due to the reduction in flow resulting from the apparatus 10 being choked or closed, the apparatus 10 are capable of re-opening to again produce, as shown in FIG. 15C.

As shown in FIGS. 15D to 15H, this process may be repeated, reducing or optimising the amount of produced water while also increasing or optimising the extraction of hydrocarbons from the reservoir.

It should be understood that the embodiments described herein are merely exemplary and that various modifications may be made thereto without departing from the scope of the invention.

The invention claimed is:

1. A method for controlling water production in a wellbore, comprising:

directing flow of a production fluid into a production conduit via a fluid flow path;

using a sensor arrangement to perform a quantitative measurement of water content within the production fluid at a sampling rate, wherein the sampling rate varies upon detection of water in the production fluid;

logging the quantitative measurement of water content within the production fluid over time to provide cumulative water content values; and configuring the flow path between a fully open configuration, a fully closed configuration and at least one intermediate configuration to vary the fluid flow in the fluid flow path based on the cumulative water content values to maintain water production at or below a predetermined threshold.

2. The method of claim 1, comprising varying the fluid flow in the fluid flow path autonomously.

3. The method of claim 1, wherein varying the fluid flow in the fluid flow path comprises reducing the size of the fluid flow path, wherein reducing the size of the fluid flow path comprises reducing the size of the fluid flow path while maintaining flow in the fluid flow path.

4. The method of claim 1, wherein the predetermined threshold is non-zero.

5. The method of claim 1, wherein reducing the size of the fluid flow path comprises fully closing the fluid flow path.

6. The method of claim 1, wherein varying the fluid flow in the fluid flow path comprises increasing the size of the fluid flow path.

7. The method of claim 1, comprising maintaining the fluid flow path when the quantitative measurement of water content in the production fluid is at or below the predetermined threshold.

8. The method of claim 1, wherein the sensor arrangement is reconfigurable from a passive state to an active state when water is detected in the production fluid.

9. An apparatus for controlling water ingress into a production conduit within a wellbore, comprising:

a body comprising an axial flow passage and a lateral flow passage configured to provide fluid communication with the axial flow passage, the apparatus defining a fluid flow passage for directing flow of a production fluid into the production conduit via a fluid flow path;

a sensor arrangement configured to log quantitative measurement of water content within the production fluid over time to provide cumulative water content values at a sampling rate, wherein the sampling rate varies upon detection of water in the production fluid; and a valve arrangement configured to vary the fluid flow in the fluid flow path based on the cumulative water content values within the production fluid by configuring the flow path between a fully open configuration, a fully closed configuration and at least one intermediate configuration to maintain water production at or below a predetermined threshold.

10. The apparatus of claim 9, wherein the apparatus is configured to vary the fluid flow in fluid flow path autonomously.

11. The apparatus of claim 9, the valve arrangement comprises a choke valve.

12. The apparatus of claim 9, wherein the sensor arrangement comprises a sensor configured to detect one or more property of the production fluid indicative of water content within the production fluid.

13. The apparatus of claim 12, wherein the sensor arrangement comprises a sensor configured to detect the presence of water, wherein the sensor configured to detect the presence of water comprises an electrical conductivity sensor (EC).

14. The apparatus of claim 13, wherein the sensor configured to detect the presence of water comprise an electrical conductivity (EC) sensor.

15. The apparatus of claim 9, wherein the sensor arrangement comprises a sensor configured to determine the water content in the production fluid, wherein the sensor configured to determine the water content of the production fluid comprises an electromagnetic (EM) flow meter.

16. The apparatus of claim 9, wherein the sensor arrangement comprises a light emitting and receiving system.

17. The apparatus of claim 9, comprising a communication arrangement, the communication arrangement comprising at least one of:

A wired communication arrangement;

a wireless communication arrangement; and a static pressure communication arrangement.

18. The apparatus of claim 9, comprising a controller configured to actuate the valve arrangement in response to the output signal from the sensor arrangement.

19. The apparatus of claim 9, comprising a power supply, the power supply comprising at least one of:

a downhole power supply;

a downhole power generator; and a battery.

20. A system for downhole water ingress control, comprising the apparatus according to claim 9.

21. The system of claim 20, comprising a plurality of the apparatus, wherein the apparatus are actuable independently.

* * * * *